United States Patent [19]

Rubio

[11] Patent Number: 4,678,212

[45] Date of Patent: Jul. 7, 1987

[54] TAILGATE LATCH MECHANISM

[76] Inventor: Richard Rubio, 3708 Missouri Ave., W. Covina, Calif. 91792

[21] Appl. No.: 835,649

[22] Filed: Mar. 3, 1986

[51] Int. Cl.[4] ..... E05C 5/02

[52] U.S. Cl. ..... 292/7; 292/DIG. 43

[58] Field of Search ..... 292/6, 7, 66, 65, 143, 292/4, DIG. 43

[56] References Cited

U.S. PATENT DOCUMENTS

| | | | |
|---|---|---|---|
| 862,612 | 8/1907 | Courtenay | 292/66 |
| 1,213,899 | 1/1917 | Petty | 292/66 |
| 1,326,554 | 12/1919 | Watson | 292/205 X |
| 1,655,489 | 1/1928 | Andersen | 292/7 X |
| 3,158,016 | 11/1964 | Fay | 292/7 X |
| 4,046,410 | 9/1977 | Connell | 292/66 X |

*Primary Examiner*—Richard E. Moore

*Attorney, Agent, or Firm*—George J. Netter

[57] ABSTRACT

A pair of locking rods are pivotally interconnected to opposite sides of a handle manipulated swivel plate and have end portions that extend, respectively, outwardly through openings in end walls of a tailgate housing. Locking plates fixedly mounted to a truck bed adjacent each side of the tailgate housing include openings for receiving the outer end portions of the locking rods and, in this manner, lock the tailgate in closed position. Coil springs serve to resiliently maintain the locking rods in an outwardly extending relation and simultaneously cause the end portions of the rods to ride up and over a locking entrance camming surface on the locking plates before being fully received within the openings of the locking plates. This latter feature permits slamming or closing of the tailgate without handle manipulation.

4 Claims, 5 Drawing Figures

TAILGATE LATCH MECHANISM

The present invention relates generally to a latching mechanism for a tailgate as used on a panel truck, for example, and, more particularly, to an improved tailgate latching mechanism which can also be slammed into closed position.

OBJECTS AND SUMMARY OF THE INVENTION

It is a primary aim and object of the present invention to provide an improved tailgate latch mechanism of simplified construction, relatively inexpensive to manufacture and of enhanced operation including the capability of slamming the tailgate to its closed or shut position.

The tailgate housing includes a forward panel and a back panel held spaced apart by end, top and bottom walls to form an intervening cavity. An external handle substantially centrally located on the outer back panel surface has parts extending through the panel and fixedly connected to a swivel plate such that rotation of the handle produces a rotation of the swivel plate parallel to the housing back panel. A pair of locking rods are pivotally interconnected to opposite sides of the swivel plate and have end portions that extend, respectively, outwardly through openings in the housing end walls.

Locking plates fixedly mounted to the truck bed and respectively located closely adjacent each side of the tailgate housing include openings for receiving the outer end portions of the locking rods and in this manner lock the tailgate in closed position. More particularly, within the tailgate housing cavity the rods are formed into hooklike portions and a coil spring has one end connected to the hooklike portion and extends angularly downwardly therefrom toward the adjacent end wall for connection to an internal strut. The spring action serves to resiliently maintain the locking rods in an outwardly extending relation (i.e., locking mode) which simultaneously causes the end portions of the rods to ride up and over a locking entrance camming surface on the locking plates before being fully received within the openings of the locking plates. This latter feature permits slamming or closing of the tailgate without handle manipulation.

DESCRIPTION OF A PREFERRED EMBODIMENT

Figure 1:
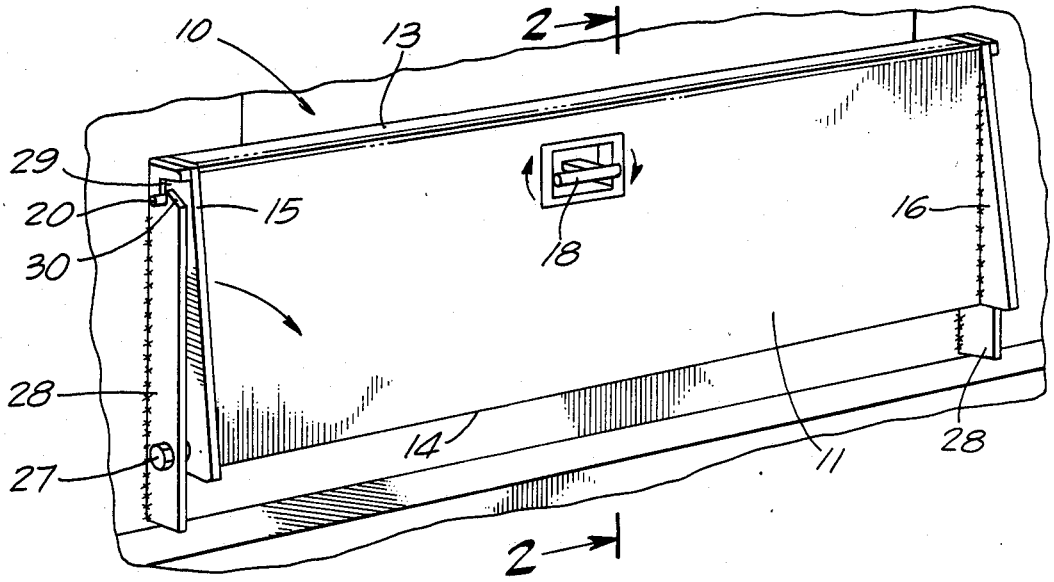
FIG. 1 is a perspective view of a tailgate.

With reference now to the drawings and particularly FIG. 1 there is shown the back end of a truck (e.g., so-called panel truck) which is releasably enclosed by a tailgate 10 including a latch mechanism to be described herein. The tailgate includes a housing consisting of a rear panel 11 and a front panel 12 of substantially the same dimensions held in separated condition from the rear panel by top, bottom and end walls 13, 14, 15 and 16, respectively. The tailgate housing encloses a central cavity 17 in which the mechanism to be described is located. A handle 18 is journaled within the rear panel and interconnected with the latch mechanism enabling selective manipulation to effect release of the latch mechanism and allow the tailgate to be dropped to an open position.

Within the housing cavity 17 a swivel plate 19 is affixed to the inner end of the handle 18 so as to rotate unitarily with the handle. A locking rod 20 has its inner end pivotally connected to the swivel plate and its opposite end extending outwardly through an opening 21 in the end wall 15 at one side of the tailgate. The rod 20 has an intermediate portion formed into a hook or loop 22 which extends downwardly at a substantially 45 degree angle away from the vertical axis. A coil spring 23 has one end connected to the loop 22 and its opposite end affixed to a strut 24 which extends between and is affixed to the front, rear and end walls of the tailgate. By the angular extension of the spring (e.g., approximately 45 degrees from vertical) the rod 20 is resiliently urged both downwardly toward bottom wall 14 and outwardly toward end wall 15.

A second locking rod 25 of substantially identical construction to the first rod 20 is pivotally connected to the opposite side of the swivel plate 19 as at 26, and, similarly, has an outer end portion extending through an opening located in the end wall 16 in the same manner as rod 20. The rod 25 is also spring-loaded in the same manner as rod 20 resiliently urging it downwardly toward strut 24 and outwardly toward end wall 16.

Figure 2:
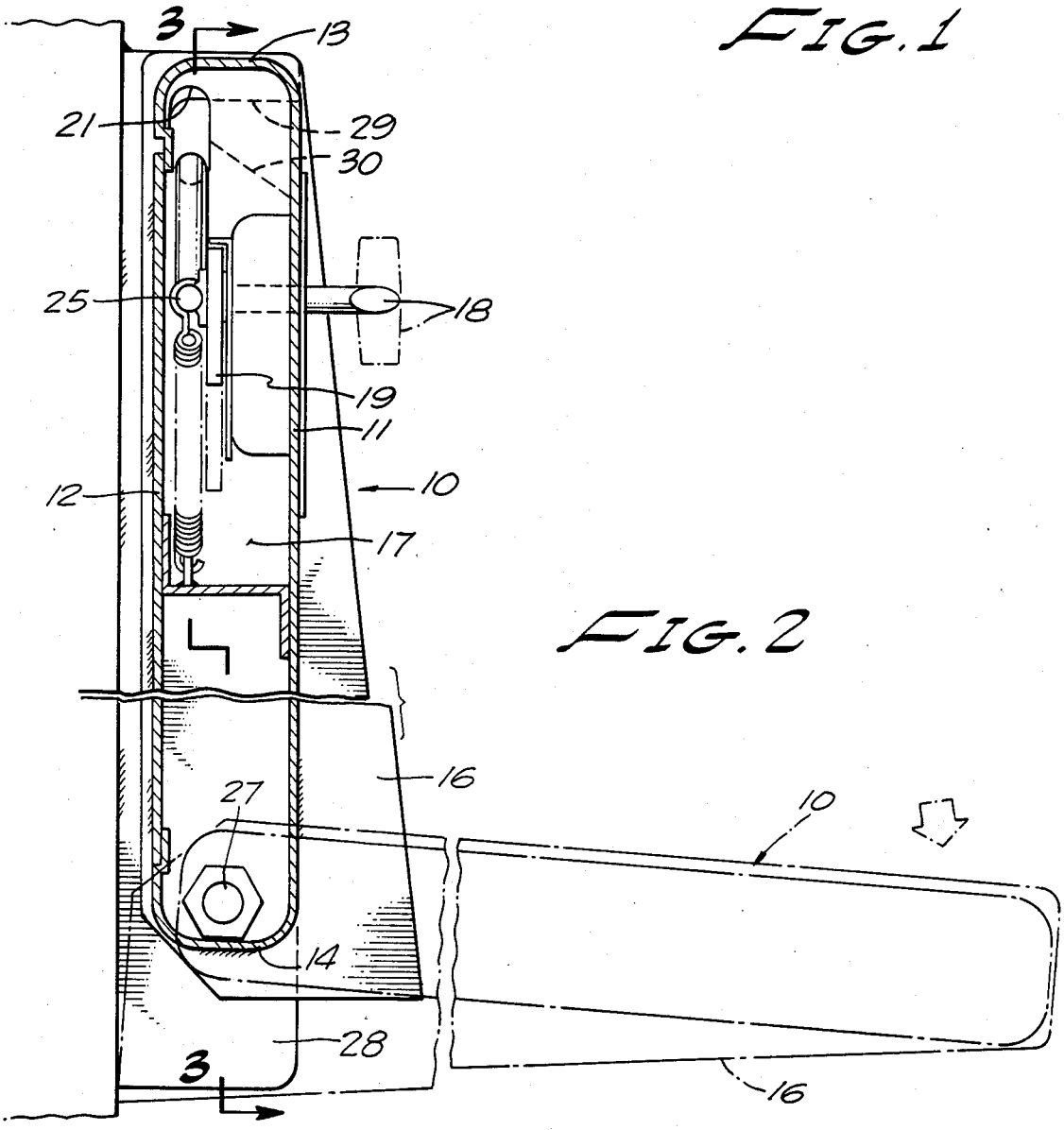
FIG. 2 is a side elevational, sectional view taken along the line 2—2 of FIG. 1.
Figure 3:
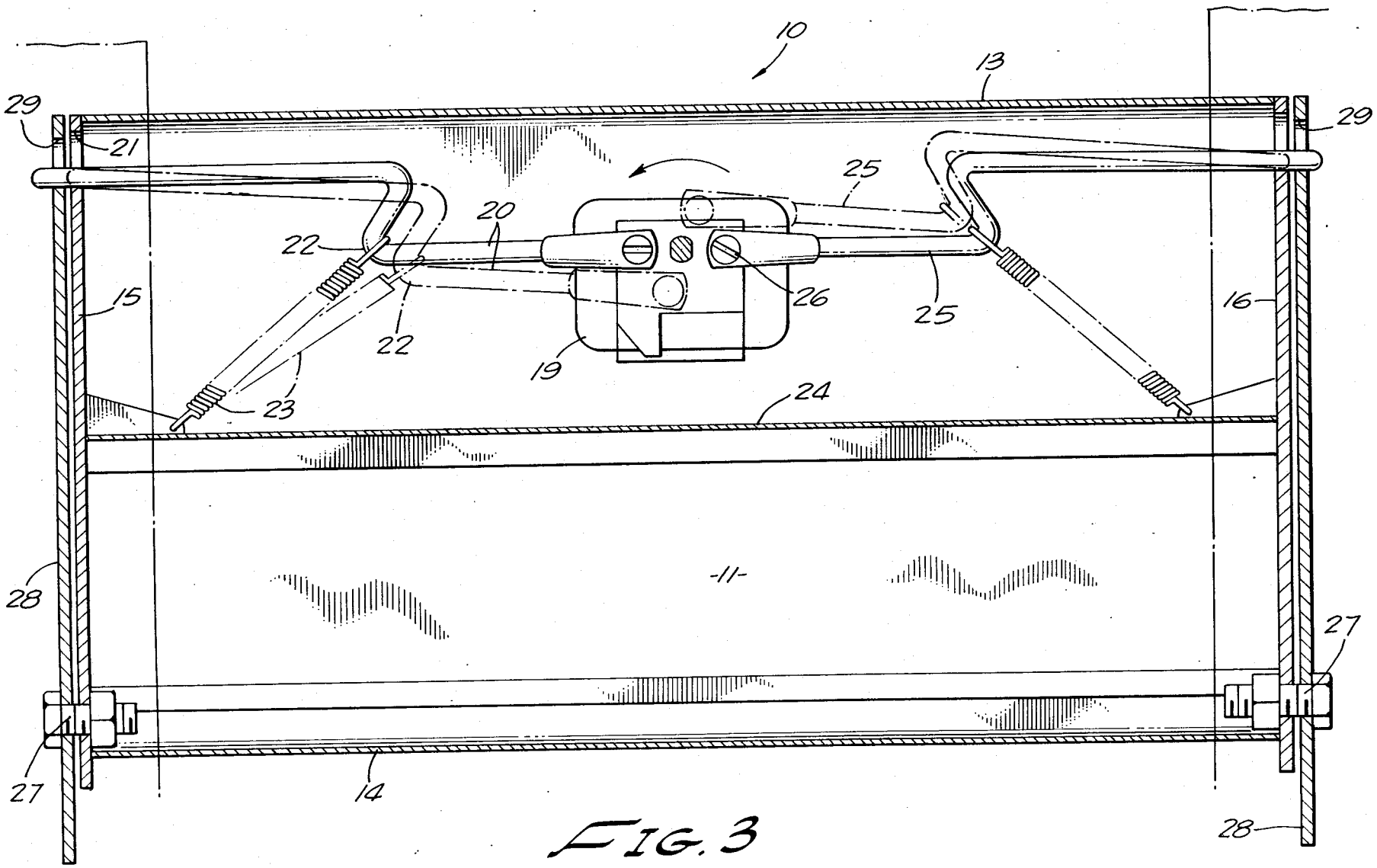
FIG. 3 is a front sectional view taken along line 3—3 of FIG. 2 showing the tailgate in latched condition.
Figure 4:
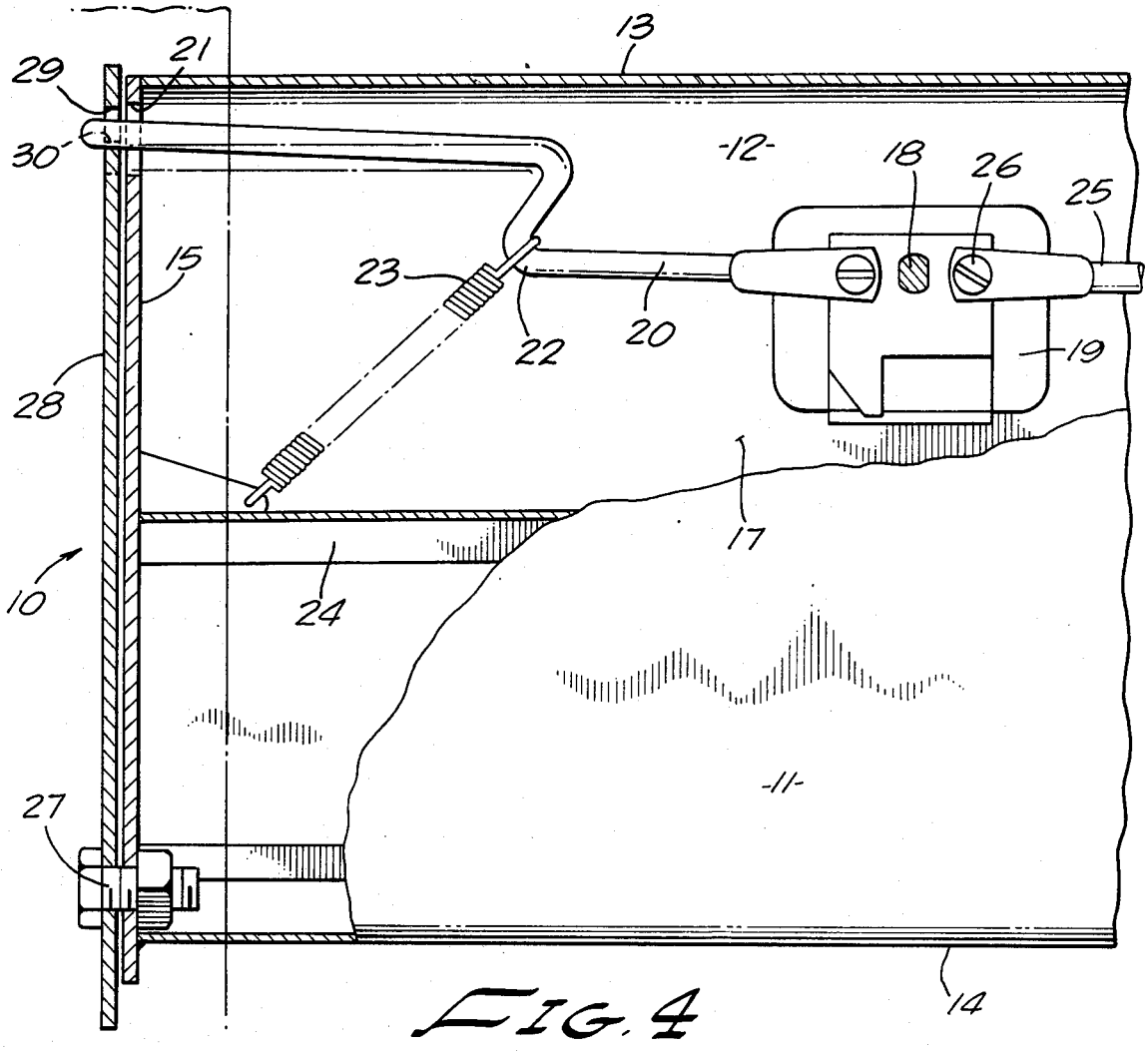
FIG. 4 is a view similar to FIG. 3 showing the latch mechanism during slamming of the tailgate.
Figure 5:
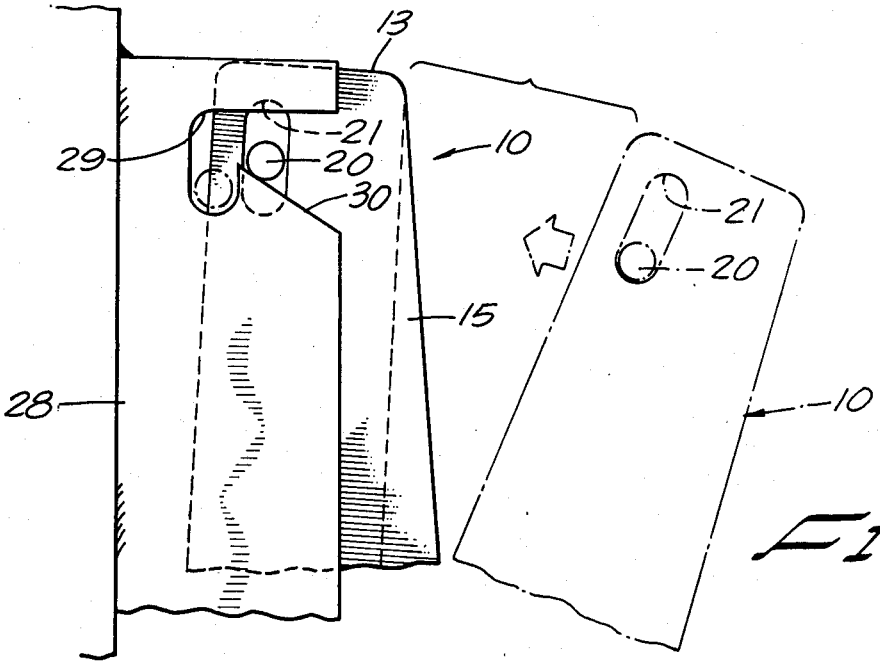
FIG. 5 is an end elevational, sectional partially schematic view showing locking rod movement during slamming.

The outer end portions of the two rods 20 and 25 extend through respective end wall openings a limited amount. Moreover, it is to be noted that the openings (e.g., opening 21) through which the rods extend in the housing end walls are elongated and that the springloading urges the rods to the bottom of their respective openings (FIG. 2).

The tailgate typically has its lower edge wall pivotally mounted to the bed of the truck as at 27 so that the tailgate may swing to a lower or open position or, alternatively, upwardly to a closed position.

Immediately adjacent the housing end wall 15 is a vertically upstanding locking plate 20 fixedly mounted to the truck bed, which, when the tailgate is swung upwardly or to a closed position, lies opposite and generally parallel to the tailgate housing end wall 15. The locking plate includes an opening 29 which is located opposite and aligned with the opening 21 in the end wall when the tailgate is in the closed position. The opening 29 also has an entrance on its rearwardly facing side including a ramp or camming surface 30. A second locking plate of identical construction (not shown) is similarly mounted on the truck bed closely adjacent housing end wall 16.

On slamming the tailgate, since the two locking rods are held by the coil springs in their lowermost position in the end wall opening 24 (and corresponding opening in 16), the tailgate on being swung upwardly towards the closed position moves the locking rod end portions into contact with the ramps 30 where they are cammed upwardly until fully seated within the locking plate openings 29. Upon the rods being so located within the locking plate openings, the tailgate cannot now be pulled out by hand since the inner side of the ramp prevents rearward movement of the rods.

Assuming the tailgate is closed and locked as already described, rotation of the handle turns the swivel plate which pulls the two locking in opposite directions but against the restraining coil springs withdrawing the rod outer end portions from the locking openings in the lock plates. The tailgate may now be swung down into the open position. When the handle is released, the coil springs automatically move the locking rods to their outermost position so that the tailgate may be slammed shut as described in the immediately preceding paragraph.

I claim:

1. A latch mechanism for releasably securing a tailgate in closed condition to a truck bed, comprising:

a tailgate pivotally mounted to swing from a closed position to an open position, said tailgate having a top edge, bottom edge and two opposite sides;

a handle rotatably mounted on the tailgate and having parts unitarily rotatable with the handle;

a swivel plate affixed to the handle parts for rotation therewith;

first and second rods pivotally connected to the swivel plate at opposite sides of the handle parts and having end portions respectively resting on first and second support means at the respective tailgate opposite sides such that an end portion of each rod extends outwardly of said tailgate opposite sides;

spring means for resiliently biasing the rods toward the tailgate bottom edge and toward the respective adjacent side; and first and second locking plate means fixedly located respectively adjacent the tailgate sides, said locking plate means each including an opening that receives the end portions of the rods therein when the tailgate is in closed condition and each said locking plate means opening has an open access including an upwardly slanted ramp which swings the outer end portions of the rods up the ramp on the tailgate being moved from open to closed.

2. A latch mechanism as in claim 1, in which the tailgate includes front, rear, bottom and end walls forming a cavity, and there is an opening in each tailgate end wall elongate in a direction generally parallel to the rear wall through which the respective rod end portion extends.

3. A latch mechanism as in claim 2, in which the rods each include an intermediate portion bent into a loop the concave portion of which faces toward the bottom wall and an end wall, and the spring includes first and second coil springs each having a respective end connected to a rod loop and the opposite end integrally affixed to the tailgate.

4. A latch mechanism as in claim 2, in which rotation of the handle when the tailgate is closed withdraws the first and second rods from the respective locking plate openings allowing rotation of the tailgate from the closed to open.

* * * * *